US009156062B2

(12) United States Patent
Vasquez et al.

(10) Patent No.: US 9,156,062 B2
(45) Date of Patent: Oct. 13, 2015

(54) VIBRATORY SCREENER CLEANING SYSTEM

(71) Applicant: DOW GLOBAL TECHNOLOGIES LLC, Midland, MI (US)

(72) Inventors: Nestor A. Vasquez, Shephard, MI (US); Mark D. Jones, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 14/355,918

(22) PCT Filed: Nov. 2, 2012

(86) PCT No.: PCT/US2012/063159
§ 371 (c)(1),
(2) Date: May 2, 2014

(87) PCT Pub. No.: WO2013/067251
PCT Pub. Date: May 10, 2013

(65) Prior Publication Data

US 2014/0291214 A1 Oct. 2, 2014

Related U.S. Application Data

(60) Provisional application No. 61/554,552, filed on Nov. 2, 2011.

(51) Int. Cl.

| | |
|---|---|
| ***B07B 1/52*** | (2006.01) |
| ***B07B 1/50*** | (2006.01) |
| ***B07B 1/38*** | (2006.01) |
| ***B07B 13/16*** | (2006.01) |
| ***B07B 1/28*** | (2006.01) |

(52) U.S. Cl.
CPC . *B07B 1/524* (2013.01); *B07B 1/28* (2013.01); *B07B 1/284* (2013.01); *B07B 1/38* (2013.01); *B07B 1/50* (2013.01); *B07B 1/52* (2013.01); *B07B 1/522* (2013.01); *B07B 13/16* (2013.01); *Y10T 29/49826* (2015.01)

(58) Field of Classification Search
CPC ..... B07B 1/00; B07B 1/46; B07B 1/50; B07B 1/52; B07B 1/522; B07B 1/524; B07B 1/28
See application file for complete search history.

(56) References Cited

U.S. PATENT DOCUMENTS

| | | | | |
|---|---|---|---|---|
| 422,974 | A * | 3/1890 | Rehmenklau | 209/351 |
| 1,647,696 | A * | 11/1927 | Hermann | 460/117 |
| 2,773,599 | A * | 12/1956 | Litus et al. | 209/386 |

(Continued)

FOREIGN PATENT DOCUMENTS

| | | |
|---|---|---|
| GB | 623 742 | 5/1949 |
| GB | 1 086 796 | 10/1967 |

*Primary Examiner* — Prasad Gokhale
(74) *Attorney, Agent, or Firm* — Kagan Binder, PLLC

(57) ABSTRACT

A vibratory screener including a screen with an upper surface, a lower surface, and a plurality of apertures, an attachment post extending above the upper surface of the screen, and a cleaning system positioned above the upper surface of the screen. The cleaning system includes a support plate, a plurality of arms extending radially from the support plate, and at least one brush extending downwardly from each of the arms. Each brush is positioned so that the distal end of at least one of its multiple bristles contacts the upper surface of the screen. The screener further includes a collection area positioned below the lower surface of the screen and a vibration generator that vibrates the screen and the cleaning system and causes the arms to rotate relative to the upper surface of the screen.

13 Claims, 4 Drawing Sheets

(56) References Cited

U.S. PATENT DOCUMENTS 3,650,401 A * 3/1972 Riesbeck et al. ..... 209/325
3,863,765 A * 2/1975 Gray ..... 209/323
4,337,158 A * 6/1982 Bodine ..... 210/785
5,222,605 A * 6/1993 Pogue ..... 209/239

* cited by examiner

VIBRATORY SCREENER CLEANING SYSTEM

CROSS REFERENCE TO RELATED APPLICATION

This application claims priority to International Application No. PCT/US2012/063159, filed on Nov. 2, 2012, which in turn claims the benefit under 35 U.S.C. §119(e) of U.S. Provisional Patent Application No. 61/554,552, filed Nov. 2, 2011, which applications are incorporated herein by reference in their entireties.

FIELD

The present invention relates generally to vibratory screeners and more particularly relates to a cleaning system used to minimize blinding of the screen of a vibratory screener.

INTRODUCTION

Vibratory screeners are commonly used for sorting material containing particles of various sizes into certain sizes by depositing a quantity of material onto a screen with holes or apertures of a predetermined size. The screen is then vibrated at a particular frequency to cause many of the smaller particles to move through the screen holes so that these particles can then be sorted further or used in other operations. After passing through the screen holes, the sorted particles can then be moved into a particle collection area. The screener vibration is also designed to keep the particles in motion and thereby move particles that are above the predetermined screen hole size into one or more oversize discharge tubes or areas so that they can be removed from the vibratory screener. The oversized particles can then be discarded or used for another purpose. Although some screeners will operate in this manner for certain periods of time, many screeners will lose efficiency when some of the small and/or large particles begin to lodge within the holes of the screen and cause the screen to become clogged or "blinded". When this occurs, particles that are within the desired size range will be blocked from falling through the screen holes and will instead be moved with the oversized particles into the discharge area, thereby causing a quantity of material within the desired size range to instead be deposited with the oversized particles.

To minimize or prevent the issues caused by a blinded or clogged screen, a number of different systems have been developed to clean particles from blinded screens, where such cleaning devices and systems are typically designed for specific applications and machines. For one example, ultrasonic generators can be used to clean screens that are used for very fine particle screening, while such generators may not be as effective for larger particles. In another example, a cleaning slider is placed on a flat surface under a screen and moved along its surface in an attempt to dislodge particles from the screen holes. In yet another example, an air sweep device is used to dislodge particles with pressurized air, which typically requires a separate dust collector to minimize the dust that is generated during the cleaning process. Although some of these systems may be effective in certain manufacturing operations, there is a continued need to provide cleaning systems that can be easily adapted for use with a circular vibratory screener to improve the efficiency of the material screening and sorting process.

SUMMARY

In accordance with the invention, a rotary vibratory screener is provided for particle separation, such as for separating selected particles of a certain size from a larger quantity of particles that have a variety of sizes. The screener comprises a screen comprising an upper surface, a lower surface, and a plurality of apertures, an attachment post extending above the upper surface of the screen, and a cleaning system positioned above a top surface of the screen. The cleaning system comprises a support plate, a plurality of arms extending radially from the support plate, and at least one brush extending downwardly from each of the arms, wherein each brush comprises a plurality of bristles that each has a distal end, and wherein each brush is positioned so that the distal end of at least one of its bristles contacts the upper surface of the screen. The screener further includes a collection area positioned below the lower surface of the screen and a vibration generator that vibrates the screen and the cleaning system and causes the arms to rotate relative to the upper surface of the screen.

In another aspect of the invention, a method of assembling a vibratory screener cleaning system on a vibratory screener is provided. The cleaning system comprises the steps of attaching an extension member to an post of the vibratory screener so that the extension member extends above an upper surface of a screen by a distance that is greater than a distance by which the post extends above the upper surface of the screen, and then removably attaching a cleaning system to the extension member, wherein the cleaning system comprises a plurality of arms extending radially from a support plate, and at least one brush extending downwardly from each of the arms, wherein each brush is positioned so that a least a portion of its length is in contact with the upper surface of the screen.

BRIEF DESCRIPTION OF THE DRAWINGS

The present invention will be further explained with reference to the appended Figures, wherein like structure is referred to by like numerals throughout the several views, and wherein.

DETAILED DESCRIPTION

Figure 1:
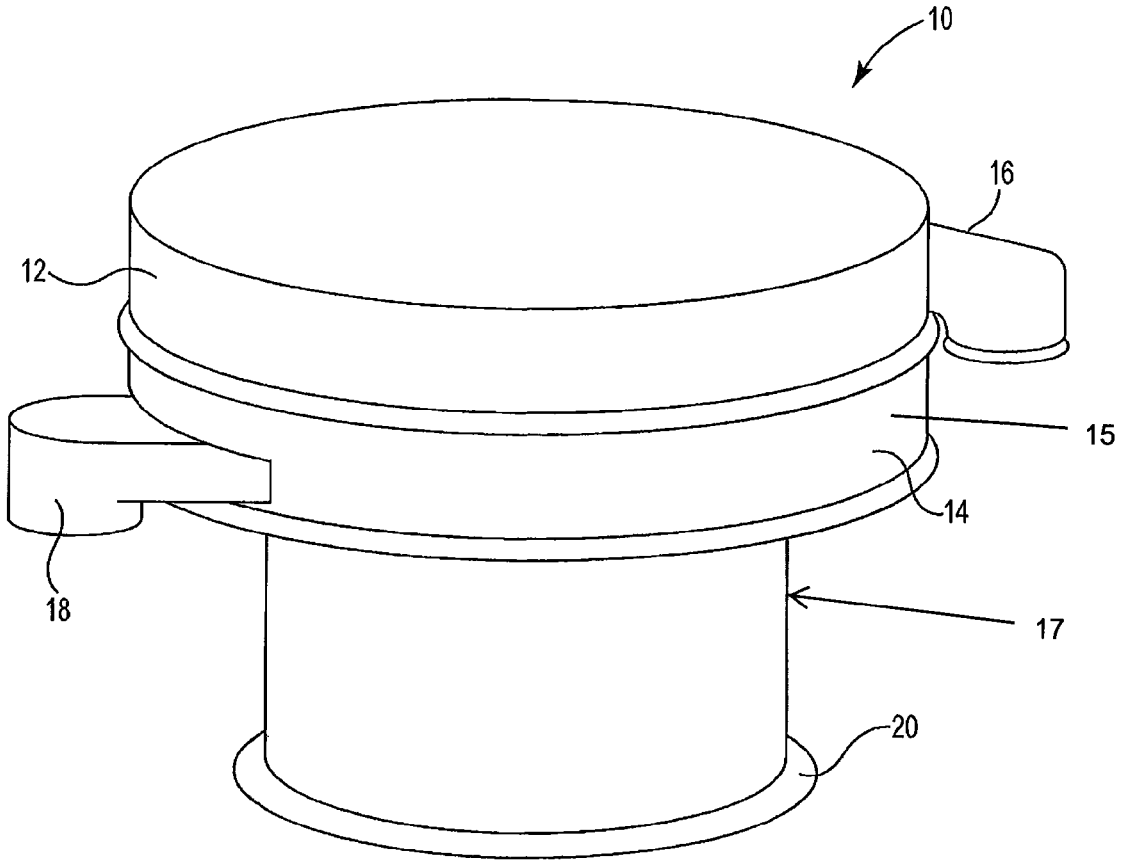
FIG. 1 is a perspective view of a vibratory screener of the type that can be used with a cleaning system of the invention.
Figure 2:
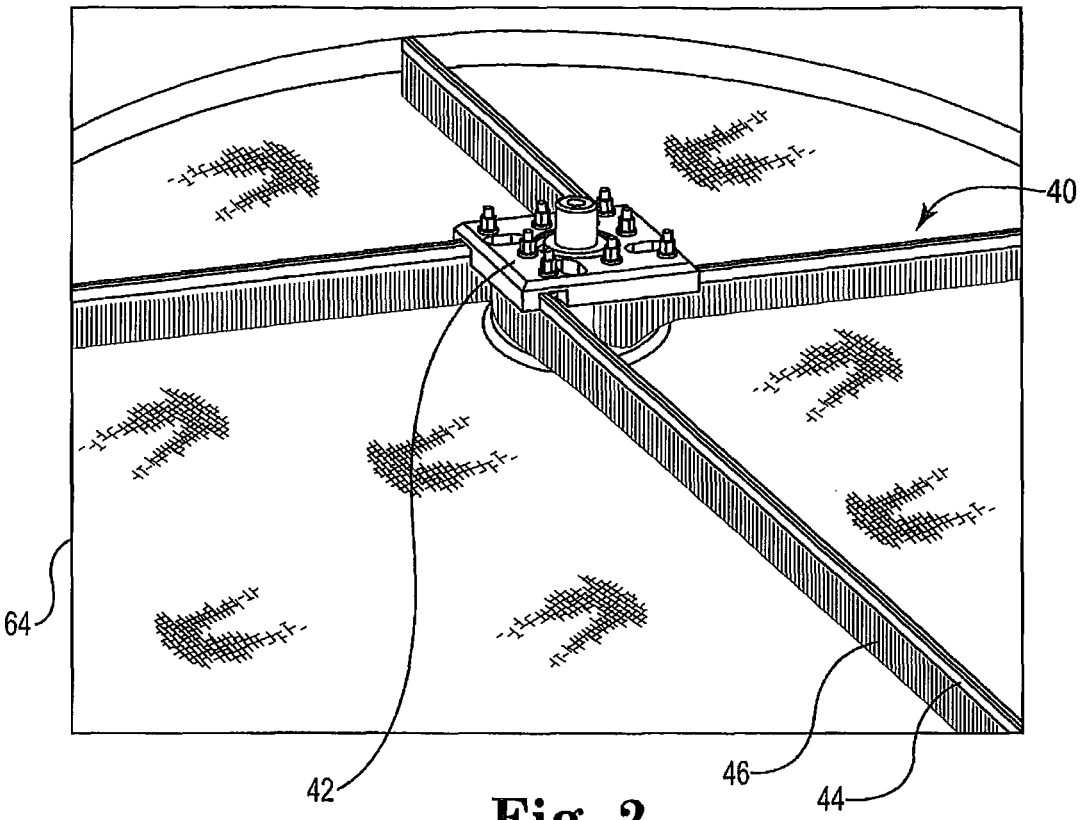
FIG. 2 is a perspective view of a portion of an embodiment of a cleaning system positioned for cleaning a screen of a vibratory screener.

Referring now to the Figures and initially to FIG. 1, an exemplary embodiment is illustrated of a vibratory screener 10 of the type that can be used in accordance with the cleaning systems and methods of the invention. Vibratory screener 10 generally includes an upper portion 12, a lower portion 14, a screen (such as a screen 64 that is illustrated in FIG. 2, for example) positioned between the upper and lower portions 12, 14 and extending across the length and width of the inner area of the screener 10, and a base 20. The screen may be positioned to be generally horizontal relative to the base 20, or may alternatively be positioned at an angle relative to the base 20. The screen is preferably planar across its length and width, although it is contemplated that the screen is at least slightly concave, slightly convex, or otherwise contoured across its length and/or width. The upper portion 12 further includes an upper discharge spout 16 extending from an opening at its outer edge, and the lower portion 14 includes a lower discharge spout 18 extending from an opening at its outer edge. The screener 10 further includes one or more motion generators (designated generally by reference number 17 in FIG. 1) that cause vibration of the screen in a vertical and/or horizontal direction.

The upper portion 12 of the screener 10 is designed to accept quantities of material (e.g., particles of varying sizes and shapes) that are deposited on the surface of the screen. The screen is designed or chosen to have holes of a predetermined size that define the desired particle size range to be collected above or below the screen. That is, although it is common to design a vibratory screener so that the material that falls through the screen is considered to be the "end product" of the screening process, it is also possible that the larger particles that stay above the screen can instead or additionally be considered to be the "end product". In any case, activation or vibration of the screener 10 and its screen will facilitate movement of particles that are smaller in size than the size of the screen holes to fall through the holes and into a collection area 15 below the screen. At the same time, vibration of the screener 10 can cause the oversized particles (i.e., particles that have at least one dimension that is larger than the holes in the screen) to move outwardly toward the outer edges of the upper portion 12 so that they can move out of the upper portion 12 through the upper discharge spout 16. The particles that fall through the screen and into the area of the lower portion 14 can then be collected and moved, such as can be facilitated by additional particle movement components, from the lower portion 14 via the lower discharge spout 18, for example. In an alternative vibratory screener, additional levels of screens and particle-receiving areas can be provided above or below the upper and lower portions 12, 14, wherein the additional screens can be provided with progressively smaller holes when moving from the top toward the bottom of the screener.

FIGS. 2-6 illustrate an embodiment of a cleaning system 40 that can be used with a vibratory screener for particle separation of the type illustrated in FIG. 1, for example. Cleaning system 40 generally includes a support member or plate 42, multiple arms 44 extending radially from the support plate 42, and at least one brush 46 extending from each of the arms 44. The cleaning system 40 is designed to be positioned relative to a screen of a vibratory screener so that the brushes are in contact with the top surface of the screen. The cleaning system can rotate relative to the screen during the particle separation or screening process, thereby minimizing blinding or blockage of the screen. The cleaning system can be removable and replaceable from the screener, such as if it is desired to use the screener without a cleaning system and/or if it is desired to use a different cleaner for a particular screening process, for example. The various components of the cleaning system are described below in further detail.

The support plate 42 of this embodiment is illustrated as being generally square in shape, although it can instead be circular, oval, rectangular, triangular, or otherwise regularly or irregularly shaped. In the illustrated embodiment in which the support plate 42 is square, one arm 44 extends from each of the four sides of the support plate 42. In order to provide a balanced cleaning system 40, each of the arms 44 can be similar or identical in size and shape to the other arms 44, where the arms 44 can be positioned and attached relative to the support plate 42 in a symmetrical manner. In particular, arms 44 can have the same general dimensions and weight and are attached in the same general location along each edge so that when the system 40 rotates, the arms 44 will remain generally in the same plane as each other and relative to the screen. A hoop or support member can optionally be provided between the ends or edges of all or some of the adjacent arms in order to modify certain bending and/or vibrational characteristics of the arms. In one embodiment, the support member or members can extend around all of the arm edges to provide a closed hoop structure.

In an embodiment in which the support plate is not square in shape, one or more arms can extend from one or more of the sides, thereby providing a cleaning system that may have more or less than four arms. It is further noted that if the shape of the support plate includes curved surfaces (e.g., circular), the plate may not include distinct "sides" and multiple arms would each therefore extend from different areas of the periphery rather than from distinct sides.

In other embodiments, a cleaning system is provided that is at least slightly unbalanced, which may be accomplished by having different numbers of arms extending from certain sides of the support plate, for example, or by providing arms within a system that have different lengths, weights, or other physical characteristics. Further, a central plate may itself have irregularly sized or shaped sides such that attachment of identically sized and shaped arms will result in a cleaning system that is asymmetrical and/or unbalanced.

Figure 4:
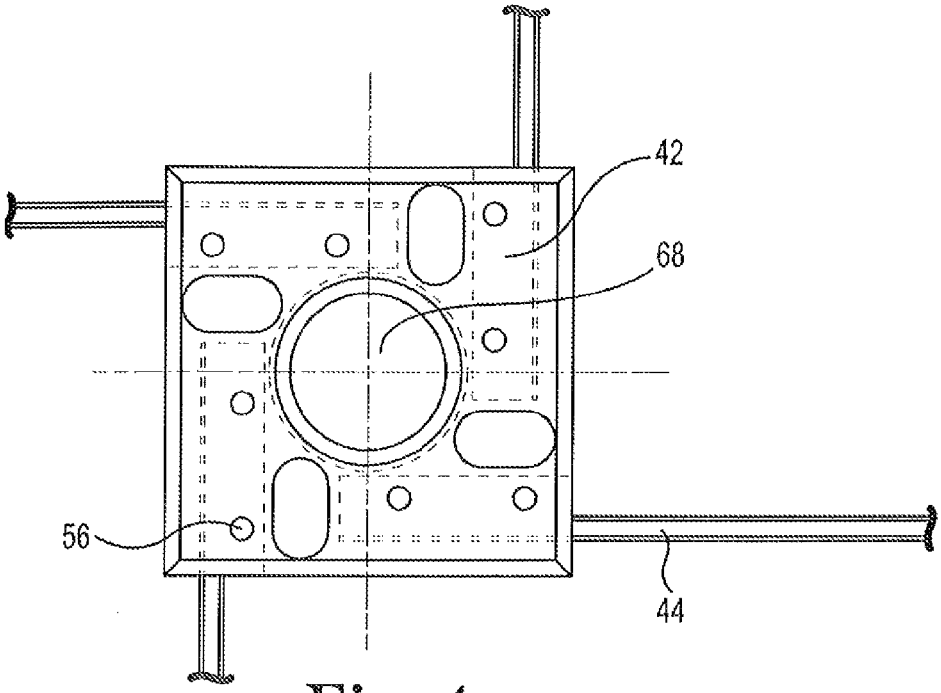
FIG. 4 is a top view of an embodiment of a support plate of a cleaning system of the invention.
Figure 5:
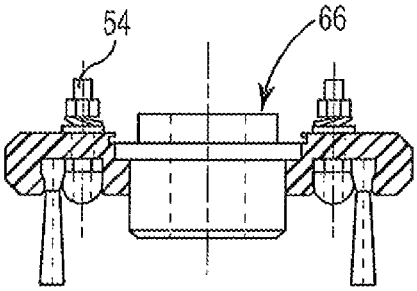
FIG. 5 is a cross-sectional view of a support plate and cleaning brushes taken along section line A-A of FIG. 4.
Figure 6:
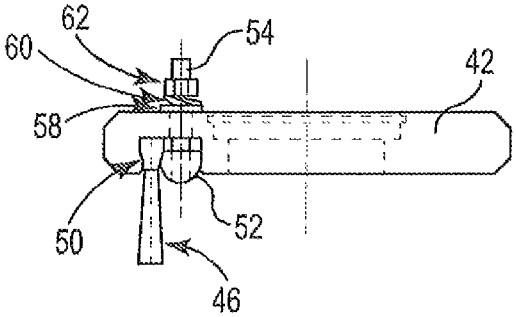
FIG. 6 is a front view of the support plate illustrated in FIG. 4.

Each of the arms 44 can be attached to its respective side of the support plate 42 in a number of different ways, with one such attachment configuration being illustrated in FIGS. 4-6. As shown, each side of the support plate 42 is provided with a channel 50 in which a proximal end of one arm 44 can be positioned. A clamp bar 52 is positioned within the channel 50 and adjacent to the arm 44 to keep the arm 44 in place within the channel 50. The clamp bar 52 includes at least one bore through which a threaded member 54 extends, or the threaded member 54 can instead be attached to a surface of the clamp bar 52 so that it extends outwardly from that surface. In either case, the clamp bar 52 is positioned so that each of its extending threaded members 54 is aligned with a corresponding hole 56 of the support plate 42. In order to secure clamp bar 52 within channel 50 in which it is positioned, one or more washers, nuts, or other fastening devices can be used. In the exemplary illustrated configuration, the threaded member 54 is provided with a flat washer 58, a lock washer 60, and a hex nut 62 that is secured to the portion of the threaded member 54 that extends above the top surface of the support plate 42. Each of the threaded members 54 can be similarly configured to extend through a hole in the support plate and secured to the top surface of the support plate.

In another attachment arrangement, the arms can be attached to a central support plate using non-threaded structures, such as elastic clamps. The arms can also be attached to the central support plate using adhesive materials, melting processes and/or combinations of these and other attachment processes or devices to provide a permanent or temporary connection of arms to a generally central support plate.

Each arm 44 is provided with a length that corresponds to a desired radius of cleaning for the cleaning system 40. That is, if it is desired for the cleaning system 40 to contact the entire surface of a screen of a particular vibratory screener, the arms 44 should have a sufficient length to reach from the support plate 42 generally to the edges of the screen (e.g., the screen edges at the sides of the upper portion 12). However, if it is desired to leave a gap between the distal edges of the arms 44 and the edges of the screen, arms 44 having a shorter length should be used. Each arm 44 can be provided with a channel or other surface to which one or more brushes 46 can be either permanently or removably attached. For example, each brush 46 can be attached via one or more fasteners to multiple locations along the length of one of its arms 44. Alternatively, each brush and arm combination can be provided as an integral unit, such as by using commercially available brushes that are attachable to the support plate 42, for example. Each length of brush may be provided as a single piece or may instead comprise multiple brushes that are adjacent to each other along one or more lines to provide a particular brush length.

Figure 3:
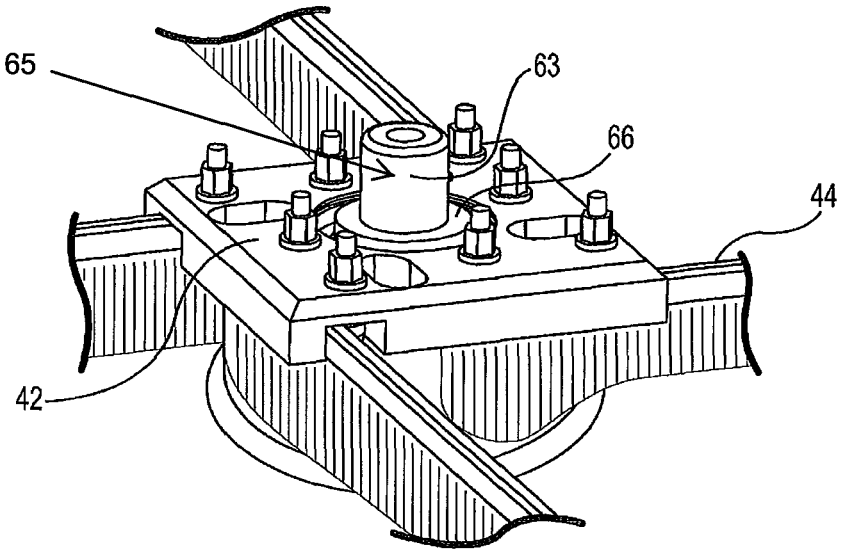
FIG. 3 is a magnified view of a portion of the cleaning system illustrated in FIG. 2.

With continued reference to FIGS. 2 and 3, the arms 44 are positioned to be generally perpendicular to the edge of the support plate 42 from which they extend. In this way, the arms 44 that extend from opposite sides of the support plate 42 are generally parallel to each other in a common plane and the arms that extend from adjacent sides of the support plate 42 are generally perpendicular to each other in that same common plane. It is contemplated, however, that the arms may extend from the sides of the support plate at different angles and/or that the arms 44 are not generally parallel and/or perpendicular to each other. Such configurations will more likely be the ease for configurations in which the support plate 42 is not a square or other symmetrical shape.

The brushes 46 can be selected or designed to include a wide variety of different features and configurations to provide a desired effectiveness of screen cleaning and minimize product contamination. For example, in order to minimize the possibility of bristles falling through the screen holes and into the sorted material, at least one dimension of the bristles should be larger than the largest dimension of the screen holes. In this way, if a portion of a bristle or an entire bristle breaks free from the brush, the bristle will not be able to fall through one of the screen holes and contaminate the sorted particles. In such a situation, the detached bristle or bristle portion can be moved to the side of the screener in the same manner that the oversized particles will be moved toward the side of the screener. Further, each of the brushes 46 are provided with multiple bristles, where the spacing and arrangement of the bristles can be selected to optimize the cleaning process. For example, the bristles can be arranged in multiple rows along the length and/or width of the brush, or the bristles may instead be arranged in a different pattern or may even be randomly arranged along the length and/or width of the brush. The bristles within each brush may be generally the same as each other, or a single brush may instead comprise bristles having different material properties, dimensions, or other features across its length and/or width. In addition, each of the brushes 46 of a particular cleaning system 40 may be generally the same as each of the other brushes of that system, or one or more of the brushes may instead be different within a single cleaning system 40.

The materials from which the bristles of the brushes of cleaning system 40 are made can vary widely, depending on the material properties of the particles being sorted (e.g., the abrasiveness of the particles), the material from which the screen is made, the expected speed at which the cleaning system will rotate, and additional or alternative considerations. For example, the bristles are preferably sufficiently stiff that they can dislodge and remove particles from the surface and holes of the screen with which they come in contact, yet are preferably not so stiff that they impede the rotation of the cleaning system. In addition, the materials from which the bristles are made are preferably selected to provide a bristle that does not show excessive wear within a short period of time. That is, while the system can be provided with brushes that are relatively easy to remove and replace relative to the arms from which they extend, it is desirable for the brushes to have a sufficiently long life that they can be used for an extended period of time (e.g., for several hours) before needing to be replaced. In some embodiments, the cleaner includes adjustment capabilities so that when the bristles become worn after a period of cleaning system use, the brushes and/or arms can be adjusted to keep at least some of the bristles in contact with the screen with an effective amount of pressure to provide the desired cleaning of the screen. In other embodiments, the bristles themselves support the weight of the entire cleaning system, such that pressure of the bristles on the screen is defined by the weight of the cleaner.

In yet another alternative, the brushes may comprise more of a comb-like configuration than a brush-like configuration. In such an embodiment, a series of teeth are spaced from each other and arranged in one or more rows along the length of the brush member, wherein the teeth are relatively stiff as compared to those that would typically be provided for a brush. A comb-like arrangement may be useful for certain screening and cleaning operations for which it is advantageous to have larger spaces between the comb teeth than are typically provided by brushes that have a much larger number of bristles that are closely spaced relative to each other.

The brushes used with the various embodiments of the invention can be brushes that are commonly referred to as commercial strip brushes. In this way, custom brushes would not necessarily need to be manufactured for a particular cleaning system, as a user of this cleaning system may be able to simply purchase commercially available brushes, such as strip brushes that are commercially available from Carolina Brush of Gastonia, N.C., for example. Such strip brushes can include a wide variety of channel sizes, filament types, sizes, and materials, and holders. An additional advantage to using commercially available brushes is that a user can optimize a cleaning process by trying a number of different brush materials and configurations, depending upon the particular cleaning conditions, without needing to commit to design and purchase a large quantity of custom-made brushes or commit to purchasing and installing brush-manufacturing equipment. In addition, a user can stock a wide variety of different brushes in order to be able to adjust and optimize the cleaning process for different particulates and other operating conditions, and can simply purchase additional brushes that provide the best operating conditions for the particular cleaning system. Therefore, such a cleaning system can be relatively cost-effective for the user.

It is further noted that the length of the brushes used for the cleaning system can be selected to correspond generally to the area of cleaning system screen for which cleaning is desired. For example, if it is desired to reach the farthest edges of the screen, one or more of the brushes can extend the entire distance from a central support plate to a peripheral edge of the screen, and in one embodiment, all of the brushes of a particular cleaning system have the same length. It is also contemplated, however, that one or more of the brushes of a particular cleaning system can extend from the central support plate by a smaller distance than at least one other brush of that cleaning system, thereby providing a cleaning system having at least one brush that is a different length than the others. Whether the brushes are the same or a different length for a particular cleaning system, the cleaning systems of the invention can be adapted for differently sized vibrator screeners simply by using brushes with an appropriate length.

Each of the brushes 46 may be positioned relative to its respective arm 44 so that all or most of the bristles are generally perpendicular to the arm 44 from which they extend and are also generally perpendicular to the screen surface with which they will come in contact. Alternatively, one or more of the brushes 46 of a particular cleaning system may be angled at least slightly relative to the surface of the screen in order to provide a different angle of contact between the bristles of the brush and the top surface of the screen. Providing such an angle for the brush bristles can be accomplished by angling a particular brush relative to the arm to which it is attached, and/or by angling the entire arm and attached brush relative to the support plate to which it is attached.

A center opening 68 through the support plate 42 is used for positioning and attaching the cleaning system 40 to the vibratory screener 10. This opening is designed to fit onto a center post 63 having a distal end 65 that extends above the screen, which is illustrated in the exemplary embodiment of FIG. 3. The center opening 68 can further contain a bushing 66 that is permanently or removably attached within the opening. The bushing 66 is preferably sized and shaped so that it can be slid over the top of the center post 63 to allow for free rotation of the support plate 42 relative to the center post 63. The bushing 66 may be made of the same or a different material from the support plate 42 in which it is positioned. In one exemplary embodiment, the bushing may be a polyethylene material that is fixed to the support plate 42 by a ring-type fastener, while the support plate is made of aluminum; however, it is understood that the center plate, the bushing and/or other components may instead be made of different metals, plastics and/or other materials or combinations thereof that provide the desired performance characteristics for the cleaning system.

The center post 63 that extends above the screen may either be specifically provided as a component of the screener for accepting a cleaning system of the type described herein, or the screener may instead be retrofit with a specifically designed attachment post extension that is attachable to a component of an existing vibratory screener. That is, some commercially available vibratory screeners are provided with a central post that extends at least slightly above the screen, wherein the portion of the post above the screen may be provided with an end section that is threaded to accept a fastener. Such a fastener can be used to hold the screen in place with respect to the center post, for example. In such a case, if the portion of the center post that extends above the screen is not long enough or otherwise is not the desired size and shape for engagement with an opening 68 of a support plate 42, a post extension can be attached to the central post. Such a post extension can be specifically configured to engage with the center opening 68 of support plate 42 and/or a bushing 66 that is positioned within the opening 68 of support plate 42. The post extension may be attachable to the center post in a number of different ways, such as via internal threads of a post extension that are engageable with external threads of a center post or by press fitting a post extension on the center post, for example.

Whether an existing center post of a vibratory screener is used or if the center post is extended by a post extension, as described above, the outer surface of the portion of the post that extends above the screen can be relatively smooth to allow for rotation of the support plate 42 and extending arms of a cleaning system 40 around this part of the post. The material from which the extending portion of the post is made is preferably compatible with the material from which the bushing and/or center opening 68 of support plate 42 are made so that movement of the components relative to each other do not cause the components to excessively wear or degrade. In some cases, it may be desirable to select the surfaces and materials so that there is a certain level of friction between the components, such as may be desired to control the rate of rotation of the cleaning system 40 relative to the center post and the screen.

As discussed above, the cleaning systems of the invention are designed to fit over a center post or other component of a vibratory screener, wherein the support plate of the cleaner is able to rotate relatively freely relative to this center post. The rotation of the cleaner is initiated and maintained by the vibration of the screener that can be used for the normal screening process (i.e., using the vibratory screener without a cleaning system). The speed and variability of rotation of the cleaner can be controllable by changing the frequency of the vibration, the amplitude of the vibration and/or the angle between the bristles and the screen in order to efficiently screen or separate the particles while preventing or minimizing the blinding and/or clogging of the screen holes. Vibration of the cleaning system can be generated and controlled in a number of different manners, such as by moving weights (not visible) to change to balance of the system and cause a certain amount of vibration. In such an embodiment, the motor can run at a generally constant speed, since the vibration is controlled by the position of the weights.

The cleaning system 40 may further be provided with a spring (not visible) positioned between a bottom surface of the support plate 42 and an upper surface of the screen, and/or positioned between a bottom surface of a bushing or other component of the support plate 42 and an upper surface of the screen. Such a spring is provided as an additional component to help support part of the weight of the cleaning system 40 and keep it in a desired orientation relative to the top surface of the screen above which it is positioned. In one particular embodiment, the dimensions of such a spring and its coefficient k are selected to provide sufficient lifting to reduce the effective weight of the cleaning system on the surface of the screen. For an example, the spring can be selected to reduce the effective weight of the cleaning device relative to the screen by at least 1%, but preferably will reduce the effective weight by between 10% and 90%. It is contemplated, however, that a spring can provide less than 10% or more than 90% effective weight reduction.

Figure 7:
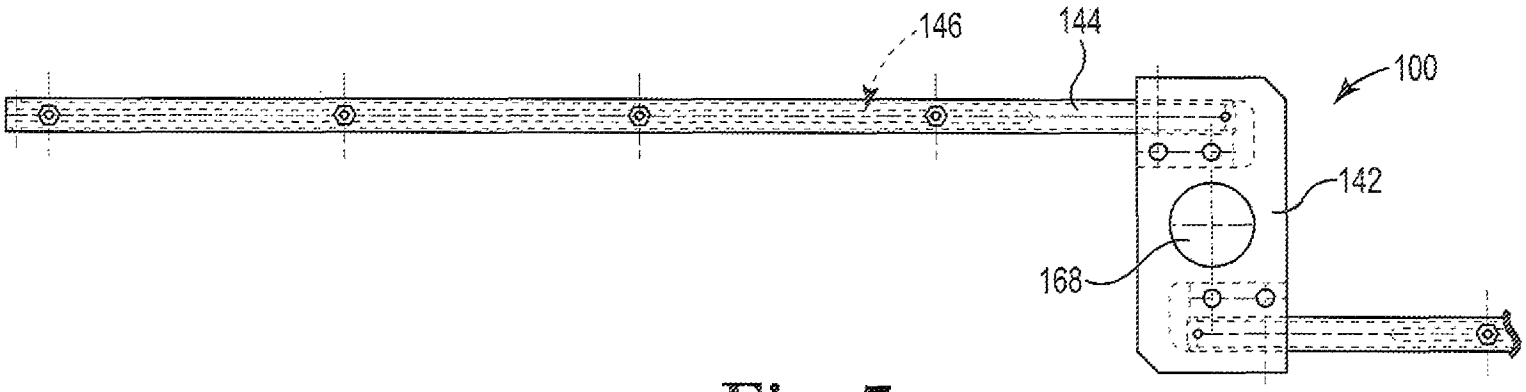
FIG. 7 is a top view of an embodiment of a cleaning system of the invention.
Figure 8:
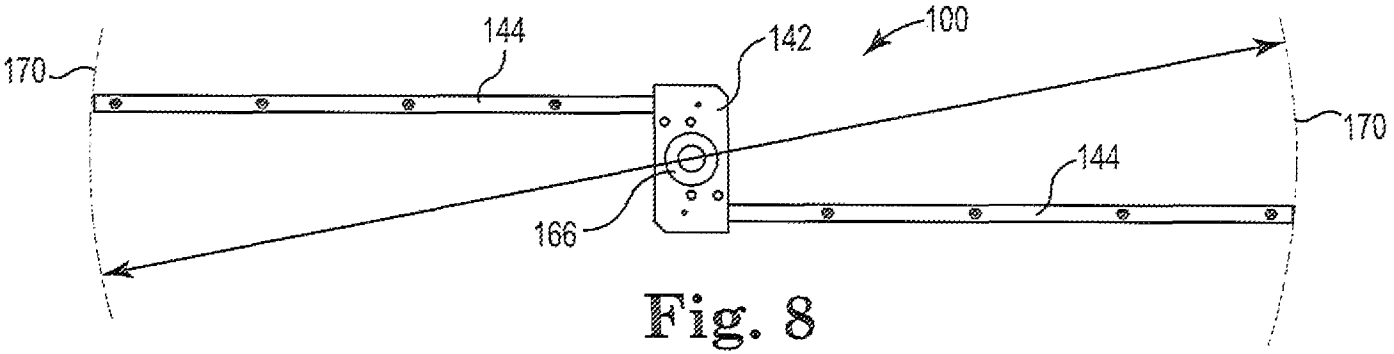
FIG. 8 is another top view of the cleaning system illustrated in FIG. 7, and further illustrating an exemplary arc along which the cleaning system can travel.

FIGS. 7 and 8 illustrate an exemplary embodiment of a cleaning system 100 that can be used with a vibratory screener for particle separation of the type illustrated in FIG. 1, for example. Cleaning system 100 generally includes a support member or plate 142, two arms 144 extending radially from the support plate 142, and at least one brush 146 extending from each of the arms 144. The cleaning system 100 is designed to be positioned relative to a screen of a vibratory screener so that the brushes can rotate relative to the screen during the particle separation or screening process to minimize blinding or blockage of the screen holes. The support plate 142 of this embodiment is illustrated as being generally rectangular in shape, with one arm 144 extending from each of two opposite sides of the support plate 142. In order to provide a balanced cleaning system 100, the arms 144 can be positioned and attached relative to the support plate 142 in a symmetrical manner. In particular, arms 144 can have the same general dimensions and weight and are attached in the same general location their two respective edges so that when the system 100 rotates, the arms 144 will remain generally in the same plane as each other and relative to the screen. However, the arms 144 may instead be attached to the support plate 142 in such a way to provide an unbalanced and/or asymmetrical system.

A center opening 168 through the support plate 142 is used for positioning and attaching the cleaning system 100 to a vibratory screener. This opening is designed to fit onto a center post that extends above the screen of the vibratory screener. The center opening 168 can further contain a bushing 166 that is permanently or removably attached within the opening. The bushing 166 is preferably sized and shaped so that it can be slid over the top of a center post to allow for free rotation of the support plate 142 relative to the center post. The bushing 166 may be made of the same or a different material from the support plate 142 in which it is positioned.

FIG. 8 illustrates a portion of the travel path of the arms 144 along an arc 170 when the cleaning system 100 rotates about the central bushing 166 and/or center opening 168. As shown, when the cleaning system 100 rotates in a counter-clockwise direction, the arm 144 on the right side will move in an upward direction, while the arm 144 on the left side will move in a downward direction. Such a cleaning system 100 can be used in any vibratory screener that has a diameter that is equal to or smaller than the distance between the distal tips of the arms 144 of this cleaning system 100.

It is noted that the terms "center" and "central" are used herein to generally indicate a positioning of certain components relative to each other; however, such a use of these terms is not intended to be limited to positioning of components in the exact center of components. Instead, these terms are used in a more general sense to describe the positioning of components in areas that are not on edges or sides, but that are instead spaced from such edges or sides.

An embodiment of the invention will now be described in detail in the following Example in which a vibratory screener or separator from SWECO (which is a business unit of M-I SWACO of Paris, France) was used to screen or separate particles. In particular, a prototype of a cleaning type of the invention as is illustrated in FIGS. 2 and 3 was installed on a commercially available SWECO vibratory screener, which was operated for eight continuous hours. The same SWECO vibratory screener was also operated for eight continuous hours without such a cleaning device installed. Both eight-hour tests were operated under the same solids flow rate of approximately 1770 kg/hour. The amount of oversized material that was collected during the eight-hour test without a cleaning device was approximately 80 kg. The amount of oversized material that was collected during the eight-hour test with a cleaning device of the invention installed was approximately 1.4 kg. This represents a reduction of 98% of yield loss.

What is claimed is:

1. A rotary vibratory screener for particle separation, the screener comprising:

a screen comprising an upper surface, a lower surface, and a plurality of apertures;

an attachment post extending above the upper surface of the screen;

a cleaning system positioned above the upper surface of the screen, the cleaning system comprising a support plate, a plurality of arms extending radially from the support plate, and at least one brush extending downwardly from each of the arms, wherein each brush comprises a plurality of bristles that each has a distal end, and wherein each brush is positioned so that the distal end of at least one of its bristles contacts the upper surface of the screen, wherein an outer periphery of the support plate includes at least three sides, and wherein at least one of the plurality of arms extends from each of the sides;

a collection area positioned below the lower surface of the screen; and a vibration generator that vibrates the screen and the cleaning system and causes rotation of the arms relative to the upper surface of the screen.

2. The vibratory screener of claim 1, wherein each of the plurality of bristles is larger in at least one dimension than a largest dimension of each of the apertures of the screen.

3. The vibratory screener of claim 2, wherein at least one of the attachment post and an extension piece extends through an orifice of the support plate.

4. The vibratory screener of claim 3, further comprising a removable and replaceable bushing positioned within the orifice of the support plate, wherein the bushing is sized and shaped to provide free rotation of the support plate relative to the attachment post.

5. The vibratory screener of claim 1, wherein each brush is removable and replaceable from its respective arm without removal of the screen.

6. The vibratory screener of claim 1, wherein at least one of the arms is removably attached to the support plate.

7. The vibratory screener of claim 1, wherein the attachment post comprises:

a center post of the vibratory screener comprising a distal end that extends above the upper surface of the screen by a first distance; and an extension piece attached to the center post so that a distal end of the extension piece extends above the upper surface of the screen by a second distance that is larger than the first distance.

8. The vibratory screener of claim 1, wherein at least one of the brushes comprises bristles that are positioned at an angle that is not perpendicular relative to the upper surface of the screen.

9. The vibratory screener of claim 1, wherein the vibration generator comprises at least one movable weight for controlling vibration of the screen and the corresponding rotation speed of the cleaning system.

10. The vibratory screener of claim 1, wherein a length of each arm is selected to correspond to an outer periphery of the screen.

11. The vibratory screener of claim 1, wherein the cleaning system is removable from the screener.

12. A rotary vibratory screener for particle separation, the screener comprising:

a screen comprising an upper surface, a lower surface, and a plurality of apertures;

an attachment post extending above the upper surface of the screen;

a cleaning system positioned above the upper surface of the screen, the cleaning system comprising:

a support plate comprising an orifice;

a plurality of arms extending radially from the support plate;

at least one brush extending downwardly from each of the arms, wherein each brush comprises a plurality of bristles that each has a distal end, and wherein each brush is positioned so that the distal end of at least one of its bristles contacts the upper surface of the screen; and a removable and replaceable bushing positioned within the orifice of the support plate, wherein the bushing is sized and shaped to provide free rotation of the support plate relative to the attachment post;

a collection area positioned below the lower surface of the screen;

a vibration generator that vibrates the screen and the cleaning system and causes rotation of the arms relative to the upper surface of the screen, wherein at least one of the attachment post and an extension piece extends through the orifice of the support plate, wherein each of the plurality of bristles is larger in at least one dimension than a largest dimension of each of the apertures of the screen, and wherein the bushing and the support plate comprise different material properties.

13. A rotary vibratory screener for particle separation, the screener comprising:

a screen comprising an upper surface, a lower surface, and a plurality of apertures;

an attachment post extending above the upper surface of the screen;

a cleaning system positioned above the upper surface of the screen, the cleaning system comprising a support plate, a plurality of arms extending radially from the support plate, and at least one brush extending downwardly from each of the arms, wherein each brush comprises a plurality of bristles that each has a distal end, wherein each brush is positioned so that the distal end of at least one of its bristles contacts the upper surface of the screen;

a collection area positioned below the lower surface of the screen;

a vibration generator that vibrates the screen and the cleaning system and causes rotation of the arms relative to the upper surface of the screen; and a spring positioned between a bottom surface of the support plate and the upper surface of the screen.

* * * * *

UNITED STATES PATENT AND TRADEMARK OFFICE

CERTIFICATE OF CORRECTION

PATENT NO. : 9,156,062 B2
APPLICATION NO. : 14/355918
DATED : October 13, 2015
INVENTOR(S) : Nestor A. Vasquez et al.

It is certified that error appears in the above-identified patent and that said Letters Patent is hereby corrected as shown below:

ON THE TITLE PAGE

Item 72, Nestor A. Vasquez's address should appear as follows: Shepherd, MI (US)

Signed and Sealed this
Twenty-third Day of February, 2016

Michelle K. Lee

Michelle K. Lee
*Director of the United States Patent and Trademark Office*